US005779576A

United States Patent [19]

Smith, III et al.

[11] Patent Number: 5,779,576

[45] Date of Patent: Jul. 14, 1998

[54] THROW-MEASURING FOOTBALL

[75] Inventors: Jay Smith, III; Kevin Hudson; Bill Hudson, all of Los Angeles, Calif.

[73] Assignee: Smith Engineering, Los Angeles, Calif.

[21] Appl. No.: 700,002

[22] Filed: Aug. 20, 1996

[51] Int. Cl.[6] ..... A63B 43/00

[52] U.S. Cl. ..... 473/570; 473/613

[58] Field of Search ..... 473/569, 570, 473/571, 574, 575, 613, 585, 586; D21/203, 204; 33/700, 713, 714; 364/565, 410; 368/250, 255

[56] References Cited

U.S. PATENT DOCUMENTS

| | | | |
|---|---|---|---|
| D. 346,001 | 4/1994 | Stillinger et al. | D21/204 |
| D. 361,811 | 8/1995 | Grimm et al. | D21/204 |
| 4,577,865 | 3/1986 | Shishido | 473/570 |
| 4,775,948 | 10/1988 | Dial et al. | 473/570 |
| 5,284,341 | 2/1994 | Routzong et al. | 473/613 |
| 5,288,069 | 2/1994 | Matsumoto | 473/571 |
| 5,316,293 | 5/1994 | Hamilton | 473/570 |

*Primary Examiner*—Steven B. Wong
*Attorney, Agent, or Firm*—Price, Gess & Ubell

[57] ABSTRACT

The invention discloses an amusement projectile characterized in a first embodiment by a football shape which is thrown by a user and which comprises electronics therein to measure and display the distance traveled by the thrown ball to the point of impact with the ground or to another user. Using an accelerometer in cooperation with a microprocessing board disposed within the ball, the distance traveled is determined by measuring the initial velocity and the time recorded during the flight of the ball based upon changes in the acceleration of the ball, and an inset liquid crystal display screen mounted on the football is used to display the distance as well as time of flight and a nondimensional thrust value. A toggle button is used to alternately display the "flight characteristics," which are distinguished by the position of a decimal in the three digit display. The toggle button also serves as an activation button which is depressed immediately prior to throwing and remains depressed until release of the ball, and which starts the timer and the accelerometer measurements upon its release. From these two measurements and data stored in a read only memory chip, the microprocessing board calculates the above identified values and causes those values to be displayed on the display screen. The invention includes an automatic shutoff characteristic which disconnects the battery after a predetermined period of inactivity.

21 Claims, 4 Drawing Sheets

THROW-MEASURING FOOTBALL

BACKGROUND OF THE INVENTION

1. Field of the Invention

The invention relates generally to amusement devices and, specifically, to a family of toy projectiles such as balls, pucks, toy airplanes and the like which can be thrown by a user or otherwise projected. In the present invention a microcomputer and display screen are included to enhance the enjoyment of a projectile by relaying to the user via a display screen certain flight characteristics such as distance thrown, velocity, and "hang time."

2. Description of Related Art

The fascination with throwing objects is universal to all cultures and people, and the allure is especially characteristic of the young. Playing "catch" with various objects has always been a favorite activity of children, and the commercial success of toy footballs, Frisbees™, baseballs, etc. is evidence of this fact. Children often engage in various games of competition to see who can throw an object the highest, the farthest, and the fastest. Competitions of this nature have been largely ignored by the prior art, as has been the natural curiosity to find out how far and how fast one can throw an object and to measure the improvement. While improvements have been made to increase the distance an object may be thrown or increase the lift on the object thereby allowing it to remain aloft for a longer period of time, means to measure the distance thrown or the time aloft, or the speed with which an object is thrown has been absent, especially in the field of children's toys. There are few options currently available on the market today where such measurements can be made automatically, and even fewer within the price range of an average children's toy. Most options include expensive equipment using either doppler technology or impact measuring equipment to judge the speed and distance of an object.

There have been attempts in the art to provide the type of feedback that the present invention provides in fields such as golf and baseball where the information is used as a learning device. These systems calculate speed and distance of golf balls, baseballs, and the like utilizing different methods such as determining the direction and speed of an object from the impact of the object with a screen comprising momentum reading instruments, and then projecting the calculated distance and trajectory therefrom. Other methods include hitting a golf ball or a baseball which is rotationally attached to a fixed member and then calculating various characteristics such as speed and distance from the speed and number of rotations of the object about the fixed member. Similarly, baseball velocity measuring devices to determine the speed of a pitched baseball is also old in the art. Recently, a hockey puck has been equipped with a velocity measuring device which can transmit data to a receiver for review and display. These systems usually cost several thousands of dollars and require expensive equipment to display the characteristics of the object being projected. Furthermore, the actual display is somewhere other than the object itself, requiring a user to focus attention alternately from a display unit to the object.

OBJECTS AND SUMMARY OF THE INVENTION

The present invention has as a first object to teach a modestly priced device which can be mounted within an object and display flight characteristics such as distance, velocity, thrust, and time aloft on the object itself. A second object is to produce an object for throwing which includes the device as recited in the preceding objective with a specific embodiment characterized by a football shape. Another object of the present invention is to teach a device which can provide immediate feedback as to information such as distance thrown, velocity, and time aloft which can economically be sold in a children's toy. These and other objects of the present invention have been achieved and will be described in detail herein.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to amusement devices capable of measuring, inter alia, a distance traveled in the air, velocity, and time aloft.

Figure 1:
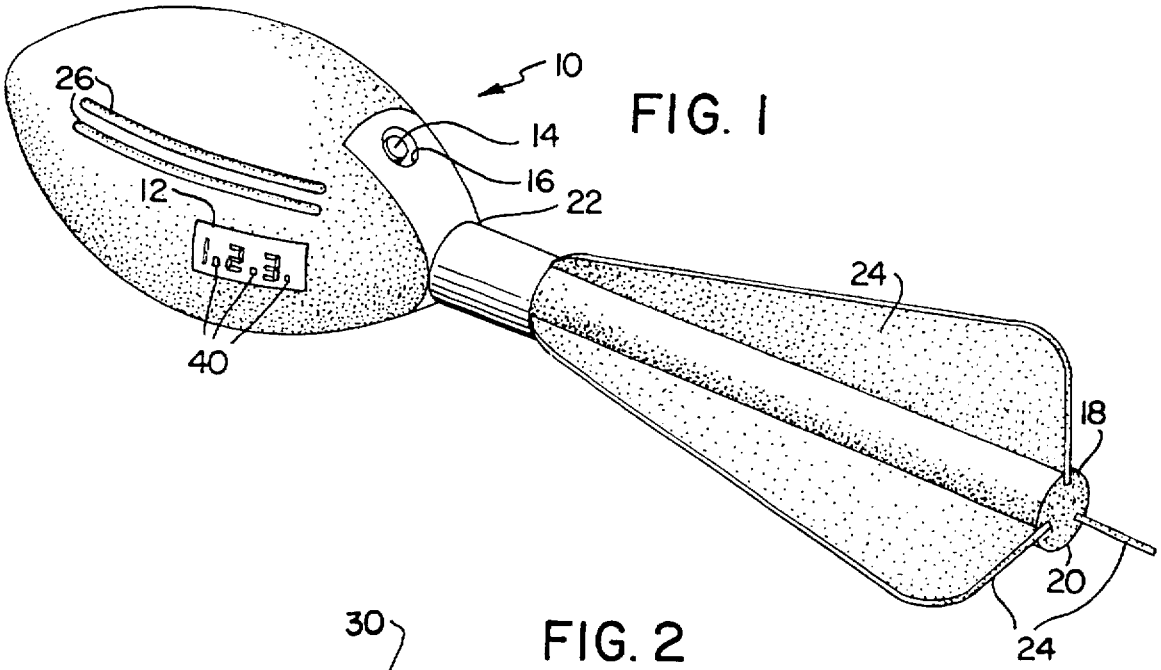
FIG. 1 is a side view of a first embodiment of the present invention illustrating a football-shaped body with a tail section, an activation button, and a display screen.

A first described embodiment 10 of the present invention is shown generally in FIG. 1. It is to be understood that the description of the first embodiment is illustrative only and that other embodiments will be readily obvious to one skilled in the art. FIG. 1 illustrates a football with a display screen 12 mounted aft of its midsection and a push button 14 in a recessed area 16 along the football's contour. In the embodiment shown in FIG. 1, the football also comprises a tail section 18 comprising a cylindrical member 20 protruding aft at the end 22 of the football with radial triangular fins 24 depending from the cylindrical member 20. In the embodiment shown in FIG. 1, the triangular fins 24 are used with one side of the each fin inserted into the cylindrical member 20, although different size and number fins are possible. The tail section 18 stabilizes the flight of a thrown football, although the tail section is merely a feature of one particular embodiment and it is not essential to the operation of the present invention. A football of the present invention may be made of a resilient foam material such as polyethylene or polyurethane which is easily molded into the desired shape and is safe for children to play with. The football may include grooves 26 longitudinally along its contour for gripping the ball in lieu of the threads which accompany traditional inflatable footballs.

Figure 2:
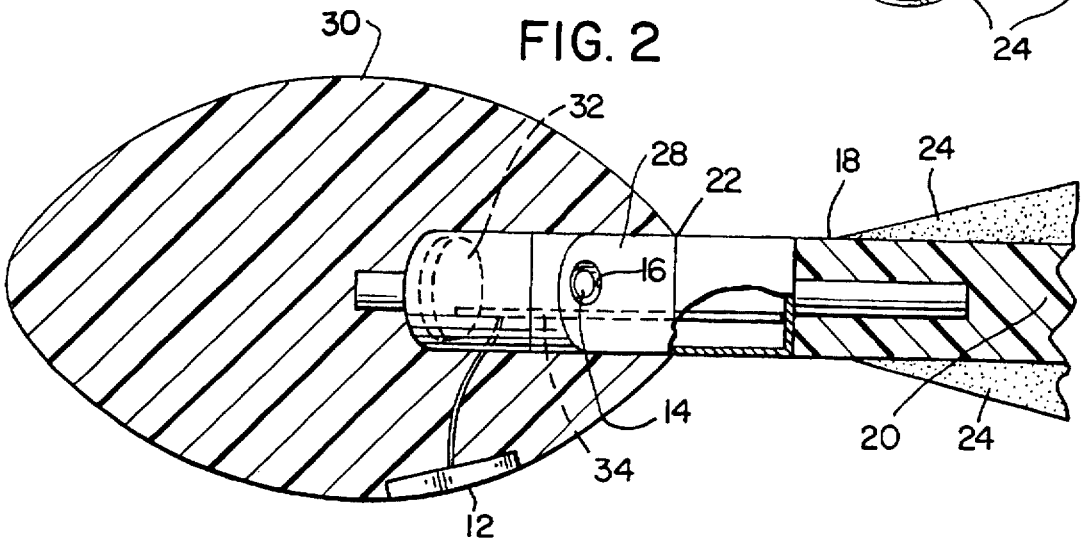
FIG. 2 is a cross-sectional view of the embodiment of FIG. 1 illustrating the components and their position within the object.
Figure 3:
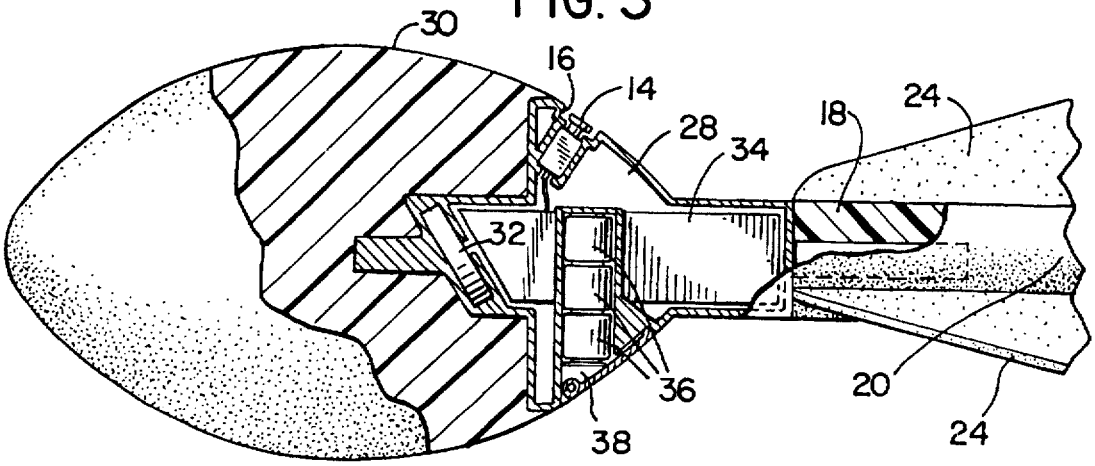
FIG. 3 is a second cross-sectional view of the embodiment of FIG. 1 illustrating the components and their position with the object.

The present invention is designed to give a user immediate feedback of "flight characteristics" of a projectile. Here, flight characteristics is used to mean distance traveled, velocity, thrust, hang time, or a combination thereof. FIGS. 2 and 3 illustrate the relative positions of the internal components of the football of the present invention. A housing 28 of a rigid plastic material is disposed within the body 30 of the football which contains and protects the electronic components and the accelerometer 32 as shown. The accelerometer 32 is preferably a piezo accelerometer, but can be any type of accelerometer which is compatible with the electronics of the present system and operates within the parameters of the objects recited above. The accelerometer is orientated at approximately a 30-degree angle with the longitudinal axis of the football, which permits the system to distinguish trajectories with too severe of loft because the vertical component of the acceleration is greater than the horizontal component. Under this condition, the football of the present invention provides a message via the display screen reading "LOB" to indicate that the trajectory was too high.

The accelerometer 32 is located adjacent and connected to a microprocessing unit 34 which performs the calculations to determine the distance, velocity, and thrust score of the football after it has been thrown. The football operates on silver oxide batteries 36 disposed in the battery compartment 38 as shown in FIG. 3, which supply the power to the microprocessing unit 34 for operation of the football. Also connected to the microprocessing unit 34 is a liquid crystal display screen 12 which is used to display the outputs of the microprocessing unit's calculations. The operation of the ball will be described first, followed by a description of the components and the mathematical formulae used in the calculations.

The football is equipped with an activation push button 14 as shown in FIG. 1. Placing the batteries 36 in their compartment 38 places the ball in its operational mode. When the ball is in the operational mode, the display screen 12 is blank until the button 14 is depressed. Once the button 14 is depressed, the display screen 12 will display three dashes indicating that the system is ready for the user to throw the ball. The user then grasps the ball and hurls it while continuously depressing the activation button 14 until the ball is released from the user's hand. Once the user throws the ball and it either lands on the ground or is caught some distance from the user, the user then retrieves the ball and views the display screen 12. If the angle of trajectory was not too steep, the display will read the calculated distance in yards traveled by the ball from the user to the point of impact. If the activation button is depressed repeatably, other characteristics such as thrust score, velocity, and hang time are displayed. The thrust score is a nondimensional score that is indicative of how hard the ball was thrown, i.e., how much thrust was placed on the ball. The display 12 indicates which value is being displayed by an indicator light 40 also serving as the decimal in the numerical values. For example, for a three-digit display, a single-digit value followed by two decimal places might designates a time value, while a single decimal could indicate distance or velocity and no decimal could designate thrust score. If the activation button 14 is depressed for three seconds or more, the screen 12 will reset and display three dashes indicating a "go" condition for another throw. The microprocessing unit 34 is programmed to include an automatic shut-off program to turn the power off when a predetermined period of inactivity has elapsed.

Figure 4:
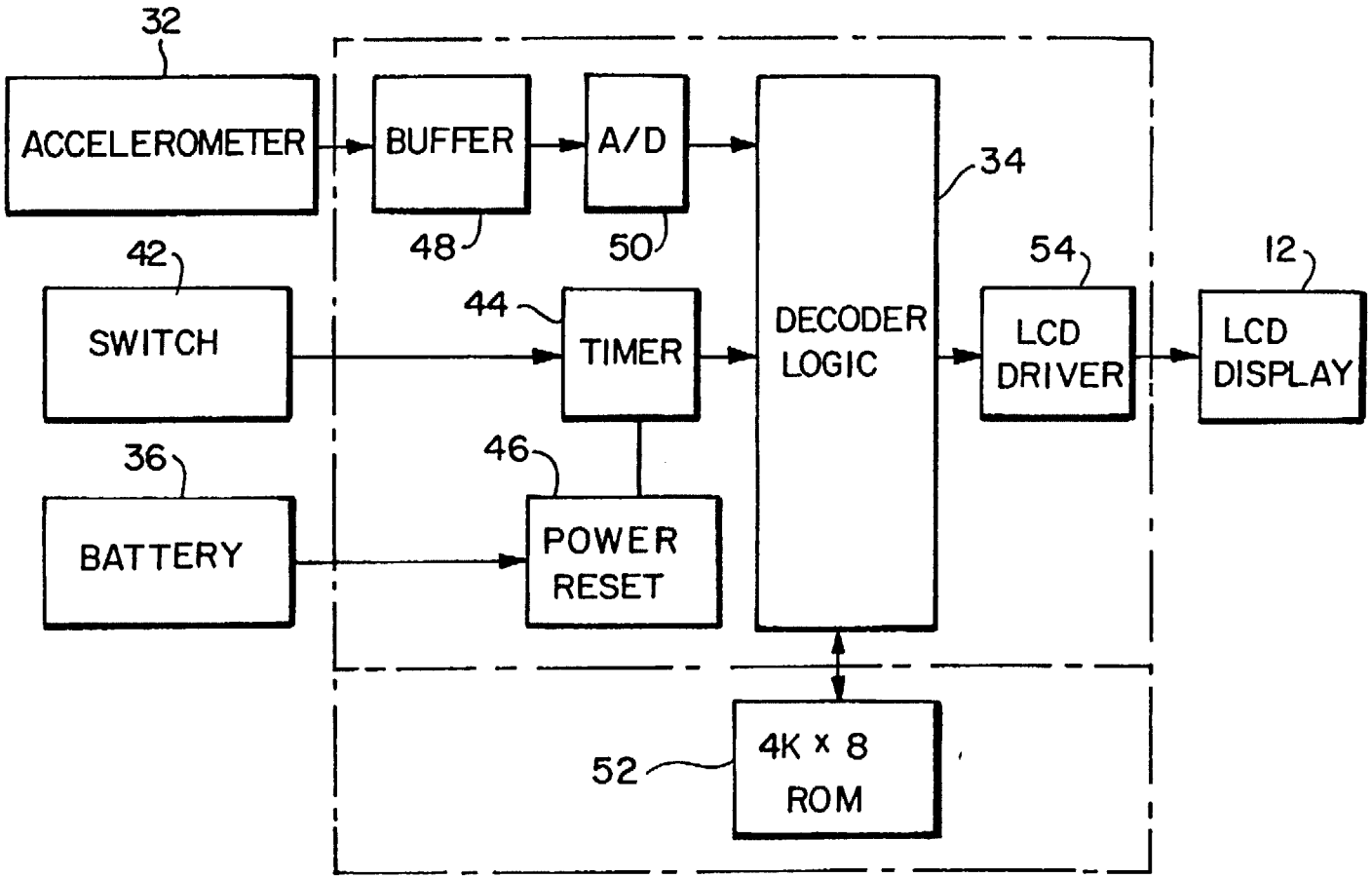
FIG. 4 is a block diagram of the components comprising the electronics of the present invention.

Turning now to FIG. 4, the system is illustrated in block diagram format. The activation button 14 triggers the switch 42 to awaken the system power timer 44 and the power reset 46. When the ball is thrown and the button 14 is released, the flight timer 44 is started and the accelerometer 32 relays data to the 5 buffer 48 which filters the data and introduces the data to the analog/digital converter 50 as shown. The analog/digital converter 50 converts the filtered signal from analog to digital and delivers the digital signal to the microprocessing unit 34. Additionally, the flight timer 44 relays a time signal to the microprocessing unit 34, which takes the two inputs and performs the calculations described below. The microprocessing unit 34 accesses a read only memory chip 52 and recalls the required data and coefficients to calculate the distance, velocity, and thrust score. These values are transferred to the liquid crystal driver 54 along with the time signal from the flight timer 44, and the liquid crystal display screen 12 sequentially displays each of these values upon a toggling of the activation button 14.

Figure 5:
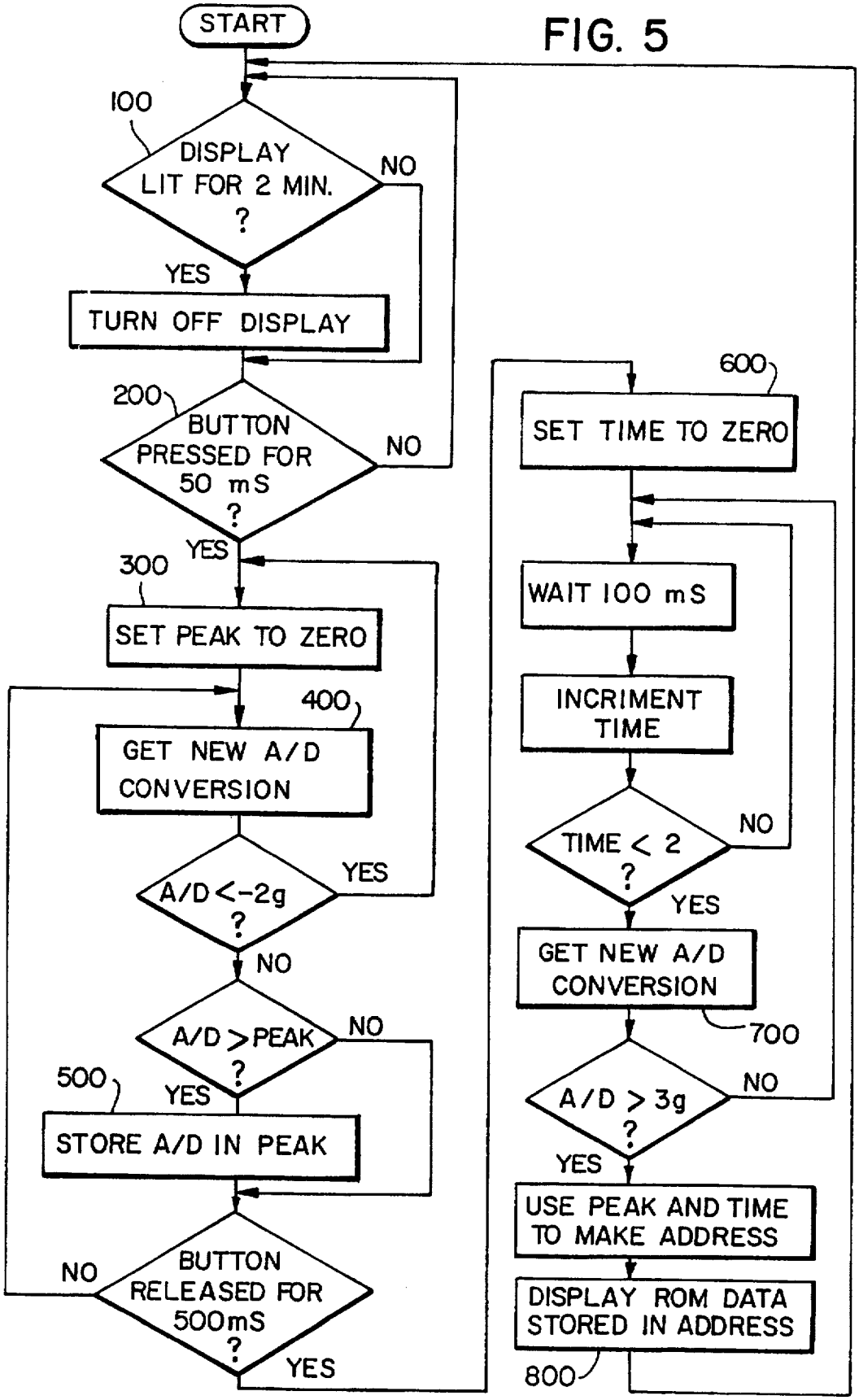
FIG. 5 is a flow chart diagram of the logic of the present microprocessor.

FIG. 5 illustrates the flowchart for the software of the present invention. The first step 100 serves as the inactivity shut-off mechanism, checking to ensure that the display has not been left on and turning off the display to preserve power if the display has been lit for more than two minutes without activity. The second step 200 checks to find out if the button has been depressed indicating a power up condition, but only if the button has been depressed for more than half a second to eliminate an inadvertent power up condition such as might occur if the ball was to bounce on the activation button after being thrown. Once the system is in a "go" condition, the third step 300 is to set to zero a peak acceleration memory value designated as "Peak," and acceleration data is retrieved from the analog/digital converter in the fourth step 400. If a retrieved value of the acceleration is less than twice the acceleration of gravity (hereinafter "g"), then no value is assigned to "peak." However, if the value retrieved from the analog/digital converter is more than 2 g, this value is assigned to the "peak" value in the fifth step 500. The 2 g value is used to distinguish any prethrow "pumping" of the ball with an actual release of the ball. The operation continues until the button has been released for 500 milliseconds, or one-half second, with each acceleration value being compared with the peak value and displacing the peak value if the current value is larger than the peak value.

Once the button has been released and the acceleration from the throw is below a predetermined threshold, the flight timer is set to zero in the sixth step 600 and started in 25-millisecond intervals. Each current acceleration signal is retrieved and checked to determine whether it exceeds a predetermined threshold, indicating an abrupt deceleration as would occur with a contact with the ground. If the threshold acceleration is not reached, the flight timer continues and the acceleration data continues to be retrieved until the threshold value is exceeded, where upon the calculations are performed based on the elapsed time and the stored peak acceleration in the seventh step 700. The stored data in the ROM is retrieved and used to calculate the distance, velocity, and thrust score, which are stored in the addresses of the microprocessor's memory, and to forward the elapsed time also stored in the memory. The final step 800 is to display the results of the calculation.

Figure 6:
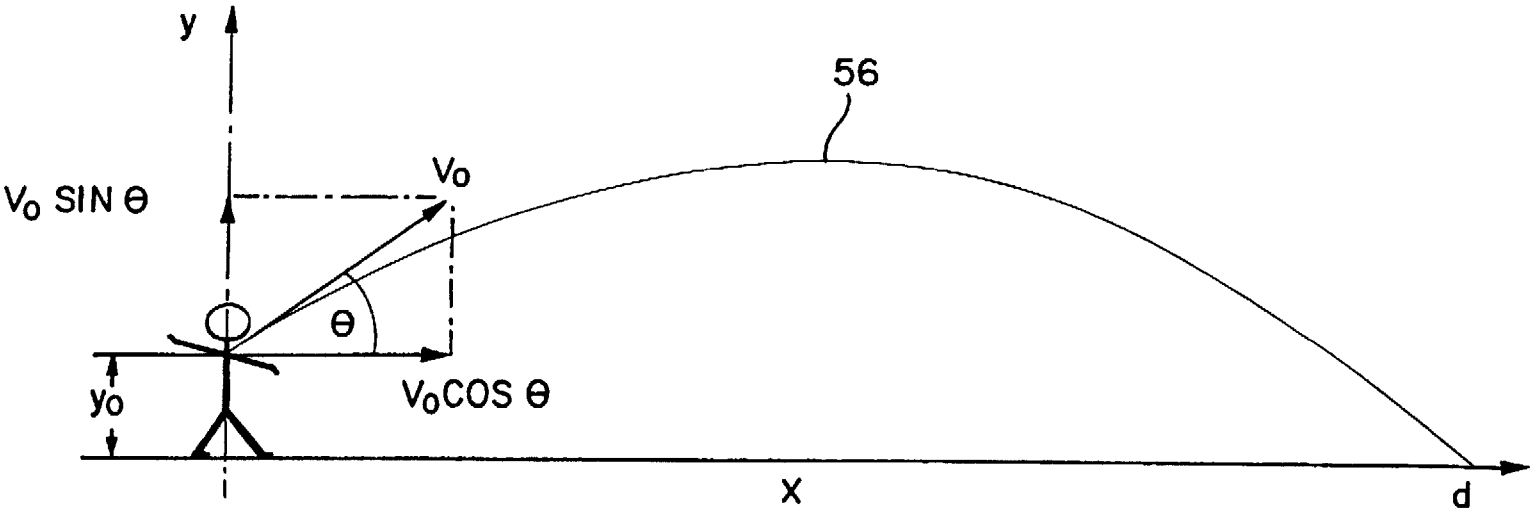
FIG. 6 is a mathematical representation of the trajectory of an object representing vertical and horizontal components with the assumptions as described fully below.

The mathematics of the calculations are now discussed herein with reference to FIG. 6.

The equation for calculating the position of a projectile traveling along the parabolic path 56 characterized by a thrown object is given by:

$$X=Vt\cos(\theta)$$

$$Y=Vt\sin(\theta)-\tfrac{1}{2}gt^2$$

where X is the horizontal component, Y is the vertical component, V is the velocity, θ is the angle relative to the horizontal, t is the time, and g is the acceleration of gravity. The effects of air resistance and friction are ignored for simplification of the calculations, and further the velocity at impact is assumed to be that of the velocity upon release. To eliminate θ from the above equations, the trigonometric relation $\sin^2\theta+\cos^2\theta=1$ is used to solve for θ in terms of X.

$$\cos(\theta) = X/Vt$$

$$\sin(\theta) = \sqrt{1-(X/Vt)^2}$$

which is valid except when V=0 and when $(X/Vt)^2$ is greater than 1. The first case is trivial because a the ball has not been thrown, and the second case is also of no consequence because X/t is the horizontal velocity component which cannot be greater than the entire velocity value V.

Substituting yields:

$$Y = Vt\sqrt{1-(X/Vt)^2} - 1/2gt^2 = \sqrt{V^2t^2-X^2} - 1/2gt^2$$

Solving for X:

$$X=\sqrt{V^2t^2-(y+1/2gt^2)^2}$$

When the object hits the ground, $y=-Y_o$ where $Y_o$ is the initial height of the object. If we further include the assumption that wind resistance is negligible, then the velocity V will be a constant $V_o$. This yields the final equation:

$$X=\sqrt{V_0^2t^2-(-Y_0+1/2gt^2)^2}$$

This equation gives the distance X in terms of the time, the initial velocity which can be determined from the output of the accelerometer, an initial height which can be estimated based on the height of the people who are anticipated to operate the device, and the gravitational constant.

It can readily be seen that the invention is applicable to a wide application of toys and other amusement devices, such as different varieties of balls, pucks, flying disks, toy airplanes, and other envisioned devices where distance traveled or velocity is of interest. For instance, the device could be included in a toy plane propelled by a catapult type device, an arrow used in conjunction with a bow, or any other projectile with a predisposed direction of flight. Other embodiments of the present invention are not to be limited to those shown here.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An amusement projectile of the type adapted to be propelled by a user through the air to land on the ground at a distance from said user, said projectile comprising a body, means for computing flight characteristics, and digital display means mounted on said body for displaying flight characteristics of said amusement projectile, said means for computing flight characteristics comprising:

accelerometer means disposed within said body for measuring an acceleration of said amusement projectile upon being propelled by said user and generating an acceleration signal representative of said measured acceleration;

signal conversion means for receiving said acceleration signal and converting said acceleration signal to a digital acceleration signal;

timer means for determining a time from a separation of said amusement projectile with said user to an impact with the ground, and generating a time signal representative of this determined time;

memory means for storing flight characteristic data;

microprocessor means for receiving said digital acceleration signal and said time signal, and for retrieving said flight characteristic data stored in said memory means, and for computing flight characteristics therefrom; and battery means for providing power to said microprocessor means.

2. The amusement projectile as recited in claim 1 wherein said accelerometer means is comprised of at least one piezo accelerometer.

3. An amusement projectile as recited in claim 2 wherein said digital display means comprises a liquid crystal display connected to said microprocessor and mounted on said body such that said liquid crystal display receives said computed flight characteristics from said microprocessor and displays said flight characteristics.

4. The amusement projectile as recited in claim 3 wherein said flight characteristics include a linear distance traveled by the amusement projectile from the user to a point of impact of the amusement projectile.

5. The amusement projectile as recited in claim 4 wherein said microprocessor means computes the distance traveled by the amusement projectile based on the following formula:

$$\text{distance} = \sqrt{V_0^2t^2-(-Y_0+1/2gt^2)^2}$$

where $V_0$ is the velocity of the amusement projectile at the time it is separated from the user, t is the time from the separation of the amusement projectile from the user until the time of impact, $Y_0$ is the assumed height of the user above the point of impact, and g is the gravitational acceleration of the earth, and where $Y_0$ and g are stored in said memory means, t obtained from said timer means, and $V_0$ is obtained from said accelerometer means.

6. The amusement projectile as recited in claim 4 wherein said flight characteristics include the time between the separation of the amusement projectile from the user and the time of impact of the amusement projectile.

7. The amusement projectile as recited in claim 6 wherein said flight characteristics include a thrust value computed by said microprocessor means from an initial acceleration signal.

8. The amusement projectile as recited in claim 7 further comprising toggle means for alternately causing the digital display means to display the time between the separation of the amusement projectile from the user, the linear distance traveled by the amusement projectile from the user to the point of impact of the amusement projectile, and thrust value.

9. The amusement projectile as recited in claim 8 wherein the said liquid crystal display includes at least three digits, and the display of the time between the separation of the amusement projectile from the user, the linear distance traveled by the amusement projectile from the user to the point of impact of the amusement projectile, and thrust value are distinguished by a position of a decimal in the display.

10. An amusement projectile as recited in claim 8 further comprising automatic shut-off means for turning off the projectile after a predetermined period of nonactivity of said amusement projectile.

11. An amusement projectile as recited in claim 10 wherein said body is comprised of a resilient foam material.

12. The amusement projectile as recited in claim 11 wherein the body of said projectile is shaped like a football, and said liquid crystal display is mounted on said body aft of a midpoint of said body.

13. The amusement projectile as recited in claim 12 wherein said body further comprises a tail section attached at an aft end thereof, said tail section comprising a cylindrical member extending from said body longitudinally along a symmetrical axis of said body, and a plurality of like fins depending radially from said cylindrical member.

14. An amusement projectile as recited in claim 13 wherein said fins are generally triangular in shape with a side of said triangular shape inserted longitudinally along said cylindrical member.

15. A device for measuring and displaying the velocity of a projectile propelled by human power where said device is mounted within said projectile, said device comprising:

user activation means mounted on the projectile for activating the device;

an accelerometer mounted in said projectile, said accelerometer adapted to measure the acceleration of said projectile and generate a signal representative of said acceleration;

a microprocessor connected to said accelerometer and adapted to receive said acceleration signal therefrom, said microprocessor further comprising timing means for determining a time between predetermined first and second acceleration peaks representing an initial velocity and contact with a stopping surface, and memory means for storing information to convert said time and said acceleration signal into a distance value representative of the distance traveled by said projectile and a velocity value representative of the velocity of said projectile;

digital display means mounted on said projectile for digitally displaying said distance value and said velocity value; and display control means connected to said microprocessor for controlling said distance value and said velocity value to be displayed on said digital display means.

16. The device as recited in claim 15 wherein said digital display means comprises a liquid crystal display screen.

17. The device as recited in claim 16 wherein said device further comprises a signal filter disposed between said accelerometer and said microprocessor for filtering noise from said acceleration signal.

18. The device as recited in claim 17 further comprising automatic power disconnect means for disconnecting a power supply from said microprocessor when a predetermined time has elapsed without activation of the device.

19. The device as recited in claim 15 where said distance value is determined from the following mathematical formula:

$$\text{distance} = \sqrt{V_0^2 t^2 - (-Y_0 + 1/2 g t^2)^2}$$

where $V_0$ is the velocity of the projectile at a time it is propelled by a user, t is the time between said predetermined acceleration peaks, $Y_0$ is an initial distance above the ground, and g is the gravitational acceleration of the earth, and where values of $Y_0$ and g are stored in said memory means.

20. The device as recited in claim 15 wherein said device further displays a thrust value indicative of the initial acceleration of said projectile.

21. The device as recited in claim 15 wherein said device further displays the time between said first and second predetermined peak accelerations.

* * * * *